US007234695B2

(12) United States Patent
Tsukamoto et al.

(10) Patent No.: US 7,234,695 B2
(45) Date of Patent: Jun. 26, 2007

(54) IMAGE FORMING DEVICE AND SHEET TRANSPORT DEVICE

(75) Inventors: Kazuyuki Tsukamoto, Kanagawa (JP); Shin Takeuchi, Kanagawa (JP); Katsumi Sakamaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 491 days.

(21) Appl. No.: 10/682,295

(22) Filed: Oct. 10, 2003

(65) Prior Publication Data

US 2004/0188916 A1 Sep. 30, 2004

(30) Foreign Application Priority Data

Mar. 24, 2003 (JP) ..... 2003-081418

(51) Int. Cl.
*B65H 3/52* (2006.01)

(52) U.S. Cl. ..... 271/122; 271/125; 271/258.01; 271/262

(58) Field of Classification Search ..... 271/10.09, 271/10.11, 10.02, 10.03, 125, 124, 122, 258.01, 271/262, 263
See application file for complete search history.

(56) References Cited

U.S. PATENT DOCUMENTS 5,172,900 A * 12/1992 Uno et al. ..... 271/125
6,231,041 B1 * 5/2001 Jacques ..... 271/121

FOREIGN PATENT DOCUMENTS

| | | | |
|---|---|---|---|
| JP | 5-32356 | | 2/1993 |
| JP | 6-72580 | * | 3/1994 |
| JP | 8-198478 | | 8/1996 |
| JP | 9-150990 | | 6/1997 |
| JP | 10-45272 | | 2/1998 |
| JP | 11-301885 | | 11/1999 |
| JP | 2000-95390 | | 4/2000 |

* cited by examiner

*Primary Examiner*—Patrick Mackey
*Assistant Examiner*—Thomas Morrison
(74) *Attorney, Agent, or Firm*—Morgan, Lewis & Bockius LLP

(57) ABSTRACT

This sheet multifeed determination device is capable of accurately detecting a sheet multifeed state, and the sheet multifeed determination device includes: a separating member side sheet speed detecting part which detects a transport speed of a sheet surface on the separating member side of a sheet transported to a nip unit of a paper feed roll and a separating member pressure-contacting mutually; a multifeed sheet detecting part which detects presence of plural sheets in the course of being transported through the nip unit; and a multifeed state determination part which determines not to be in a multifeed state of sheets when the sheet speed detected by the separating member side sheet speed detecting part is $V2 \leqq 0$ and determines to be in the multifeed state of sheets in the case of $V2>0$ in a condition where the multifeed sheet detecting part detects multifed sheets.

8 Claims, 8 Drawing Sheets

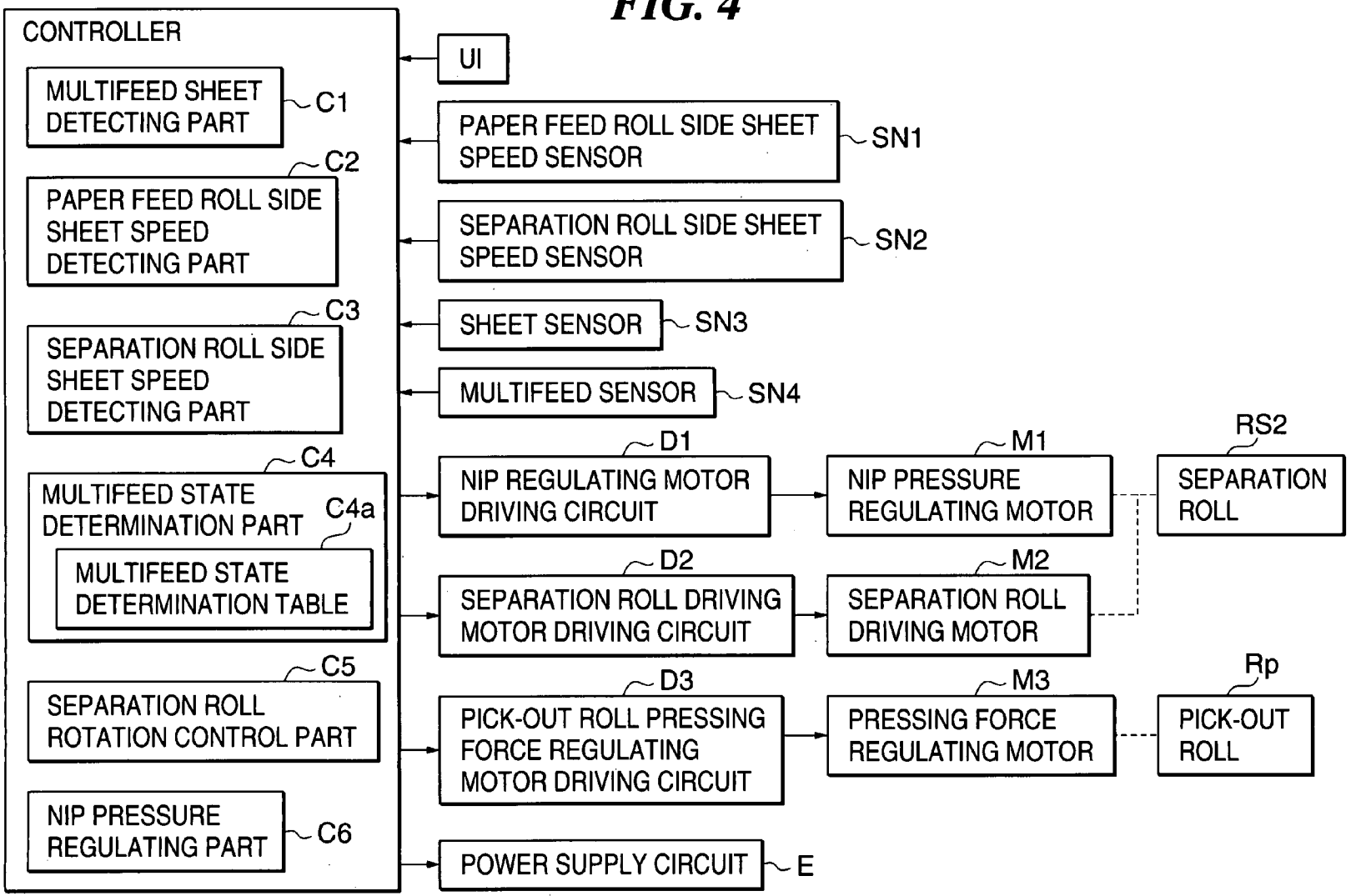
FIG. 4
UI
SN1
PAPER FEED ROLL SIDE SHEET SPEED SENSOR
SN2
SEPARATION ROLL SIDE SHEET SPEED SENSOR
SN3
SHEET SENSOR
SN4
MULTIFEED SENSOR
D1
NIP REGULATING MOTOR DRIVING CIRCUIT
D2
SEPARATION ROLL DRIVING MOTOR DRIVING CIRCUIT
D3
PICK-OUT ROLL PRESSING FORCE REGULATING MOTOR DRIVING CIRCUIT
E
POWER SUPPLY CIRCUIT
M1
NIP PRESSURE REGULATING MOTOR
M2
SEPARATION ROLL DRIVING MOTOR
M3
PRESSING FORCE REGULATING MOTOR
RS2
SEPARATION ROLL
Rp
PICK-OUT ROLL
CONTROLLER
C1
MULTIFEED SHEET DETECTING PART
C2
PAPER FEED ROLL SIDE SHEET SPEED DETECTING PART
C3
SEPARATION ROLL SIDE SHEET SPEED DETECTING PART
C4
MULTIFEED STATE DETERMINATION PART
C4a
MULTIFEED STATE DETERMINATION TABLE
C5
SEPARATION ROLL ROTATION CONTROL PART
C6
NIP PRESSURE REGULATING PART

FIG. 5

SHEET MULTIFEED STATE DETERMINATION TABLE C5a

| No. | MULTIFEED SENSOR SN4 | SPEED SENSOR B DETECTING SPEED V1, V2 OF SN 1, SN2 | DETERMINATION |
|---|---|---|---|
| 1 | OFF | V2 = V1 | NORMAL (ONLY ONE SHEET IS TRANSPORTED) |
| 2 | ON | V2 = 0 | NORMAL (SECOND SHEET IS STOPPED) |
| 3 | ON | V2 < 0 | NORMAL (SECOND SHEET IS PUSHED BACK) |
| 4 | ON | V2 = V1 | MULTIFEED (CONTACT STATE) |
| 5 | ON | V1 > V2 > 0 | MULTIFEED (IMPERFECT SEPARATION) |

IMAGE FORMING DEVICE AND SHEET TRANSPORT DEVICE

BACKGROUND OF THE INVENTION

1. Field of the Invention

The invention relates to an image forming device and particularly to the sheet transport device of the image forming device.

2. Description of Related Art

A paper feed member of this type of sheet transport device is so constructed that when two or more sheets are transported to a nip unit, one sheet is separated and transported to the downstream side in the sheet transport direction by a paper feed roll rotated to apply the force in the transport direction to the sheets transported to the nip unit and a separating member coming into contact with the transported sheets to generate the force for hindering the transport of the sheets. As the separating member brought into pressure contact with the paper feed roll, used is a roll-like member or a pad-like member having a pressure contact surface to the paper feed roll. In the case of using the roll-like member (a separation roll) as the separating member, the separation roll is rotated in the reverse direction to the sheet transport direction, thereby applying not only the force for hindering the transport of the sheets, but also the force for transporting the same in the reverse direction.

When the pressure contact force (pressure contact force of the nip unit, that is, the nip pressure) of the paper feed roll of the paper feed member and the separating member is too small or large, the transport force of the pick-up roll is too large or small, or the relationship between the transport force of the pick-up roll and the nip pressure is unsuitable, the sheets can't be surely transported one by one to the downstream side in the sheet transport direction of the paper feed member.

In the sheet transport device to which the invention applies, for example, when the contact pressure force (nip pressure) of the paper feed roll of the paper feed member and the separating member is too small, misfeed (sheet transport is not accomplished by the paper feed member) is caused. In the case where the pressure contact force is too large, when two or more sheets are simultaneously transported to the nip unit, one of the sheets can't be separated to cause multifeed of sheets (two or more sheets are transported to the downstream side without separation).

In order to prevent the occurrence of abnormal conditions in transporting a sheet, various proposals have been made heretofore, and the techniques described in the following Patent References are publicly known.

(1) Technique described in the Patent Reference 1 (Japanese Published Unexamined Patent Application No. Hei-5-32356)

According to the technique described in the patent document, a paper sheet picked up by a nudger roller (pick-up roll) is transported to a nip unit (a pressure contact area) between a feed roller (a paper feed roll) and a retard roller (a separating member) constituting a paper separating mechanism. When misfeed or multifeed is detected according to a detection signal of a misfeed detecting sensor and a multifeed detecting sensor disposed on the downstream side of the nip unit (the pressure contact area), the nip pressure (the pressure of the nip unit) is automatically controlled at any time.

(2) Technique described in the Patent Reference 2 (Japanese Published Unexamined Patent Application No. Hei-10-45272)

This Patent Reference describes a separating device including a transport roller rotated in the paper feed direction and a separation roller brought into pressure contact with the transport roller and rotated in the reverse direction to the paper feed direction. The pressure contact force of the transport roller and the separation roller is set to a small value not to feed a sheet properly at the start of feeding a sheet. The pressure contact force regulating part is controlled so that the value is gradually increased until a sheet detecting part determines the proper feeding of the sheet, and then the value at the time is kept until the separation of the sheets is completed.

(3) Technique described in the Patent Reference 3 (Japanese Published Unexamined Patent Application No. Hei-9-150990)

This Patent Reference describes the technique for transporting a paper sheet transported by a pick-up roller 20 to a pressing portion between a separation roller 21 and an opposite member 25, separating one paper sheet coming into contact with the peripheral surface of the separation roller 21, and transporting the same toward the downstream in the paper transport direction. In the technique, according to the detected speed of a paper transport speed detecting roller 41 disposed on the downstream from the separation roller 20, the pressing force P of the pick-up roller 20 and the separating force of the separation roller 21 are controlled to control the paper transport speed to a proper value, thereby normally transporting the paper sheet.

In order to normally transport the sheet as in the Patent References 1 to 3, various sheet multifeed detection methods for detecting the occurrence of abnormal sheet transport have been proposed heretofore, and the techniques described in the following Patent References (4) to (6), for example, are publicly known.

(4) Patent Reference 4 (Japanese Published Unexamined Patent Application No. Hei-11-301885)

This Patent Reference describes the technique for deciding multifeed of sheets according to the electrostatic capacity of a parallel plate electrode capacitor.

(5) Patent Reference 5 (Japanese Published Unexamined Patent Application No. 2000-095390)

This Patent Reference describes the technique for disposing an ultrasonic oscillator and a receiver on the upper side and lower side of a sheet transport path, and detecting the multifeed of sheets according to the information obtained from the oscillator and receiver.

(6) Patent Reference 6 (Japanese Published Unexamined Patent Application No. Hei-8-198478)

This Patent Reference describes the technique for detecting the multifeed of sheets according to the moving distance of a detecting roller to a transport roller when the sheet is transported.

[Patent Reference 1]: Japanese Published Unexamined Patent Application No. Hei5-32356 (Paragraph No. [0009], FIG. 1)

[Patent Reference 2]: Japanese Published Unexamined Patent Application No. Hei 10-45272 (Paragraph No. [0015], FIG. 4)

[Patent Reference 3]: Japanese Published Unexamined Patent Application No. Hei 9-150990 (Paragraph No. [0015], [0015], [0017] to [0020], FIG. 1)

[Patent Reference 4]: Japanese Published Unexamined Patent Application No. Hei 11-301885 (Abstract on page 1)

[Patent Reference 5]: Japanese Published Unexamined Patent Application No. 2000-095390 (Abstract on page 1)

[Patent Reference 6]: Japanese Published Unexamined Patent Application No. Hei 8-198478 (Abstract on page 1)

In all techniques described in the above Patent References 4 to 6, multifeed is detected when the sheets pass through the preset position of the multifeed sensor. Accordingly, in the case where the multifeed is released by regulating the nip pressure or the like, release of multifeed can't be detected until the sheets to be separated are sent back and returned to the multifeed sensor position, resulting in causing delay in detection. On the other hand, in the case where the sheets to be separated are stopped in spite of the separating action, detection of multifeed remains as it is.

SUMMARY OF THE INVENTION

The present invention has been made in view of the above circumstances and provides an image forming device, which may improve the determination accuracy for the sheet multifeed state.

The invention proposed to solve the above problems will now be described. The elements of the invention are designated by parenthesizing the reference numerals and signs of elements of an embodiment to facilitate correspondence between the invention and an embodiment mentioned later. The reason why the invention is described by a correspondence with the reference numerals and signs of an embodiment mentioned later is that the invention may be easily understood, not that the scope of the invention is limited to an embodiment.

In order to solve the problems, an image forming device for a sheet to which the invention is applied includes a paper feed member which applies a force in a transport direction to the sheet and a separating member which applies a force in a direction of hindering the sheet transport, and in the apparatus, two or more multifed sheets are separated by the paper feed member and the separating member. The image forming device includes a sheet speed detecting part which detects a transport speed V2 of a sheet on the separating member side, a multifeed sheet detecting part which detects the transport of plural sheets, and a control part which determines to be non-multifeed and controls paper feed when the speed V2 detected by the sheet speed detecting part is $V2 \leqq 0$ and the multifeed sheet detecting part detects the transport of the plural sheets.

An image forming device for a sheet to which another invention is applied includes a paper feed member which applies a force in a transport direction to a sheet, and a separating member which applies a force in a direction of hindering the sheet transport, and in the apparatus, two or more multifed sheets are separated by the paper feed member and the separating member. The image forming device includes a paper feed member side sheet speed detecting part which detects a transport speed V1 of a sheet on the paper feed member side, a separating member side sheet speed detecting part which detects a transport speed V2 of a sheet on the separating member side, a multifeed sheet detecting part which detects the transport plural sheets, and a control part which controls paper feed when a relationship between the speed V1 detected by the paper feed member side sheet speed detecting part and the speed V2 detected by the separating member side sheet speed detecting part is $V1>V2>0$ and the multifeed sheet detecting part detects the transport of the plural sheets.

In order to solve the problems, a multifeed state determination device for a sheet according to another invention is characterized by providing the following constituent features (A01) to (A04).

(A01) A paper feed member (Rs) including a paper feed roll (Rs1) and a separating member (Rs2) forming a nip unit (N) by mutually pressure contact portions or mutually adjacent and opposite portions, wherein the paper feed roll (Rs1) rotates to apply the force in the transport direction to a sheet (S) transported to the nip unit (N), and the separating member (Rs2) generates the force for hindering the transport when it comes into contact with the transported sheet (S), whereby when two or more sheets (S) picked up from paper feed trays (TR1, TR2) by a pick-up roll (Rp) are transported to the nip unit (N), one sheet (S) on the paper feed roll (Rs1) side of two or more sheets (S) is separated and fed to the downstream side in the sheet transport direction.

(A02) A separating member side sheet speed detecting part (C3) which detects the transport speed V2 of a sheet surface on the separating member (Rs2) side of a sheet (S) in the course of passing through the nip unit (N), which is a pressure contact area of the paper feed roll (Rs1) and the separating member (Rs2).

(A03) A multifeed sheet detecting part (C1) which detects the presence of two or more sheets (S) in the course of being transported through the nip unit (N).

(A04) A multifeed state determination part (C4) which determines to be not in the multifeed state of the sheets (S) in the case where the sheet speed V2 detected by the separating member side sheet speed detecting part (C3) is $V2 \leqq 0$, and determines to be in the multifeed state of the sheets (S) in the case of $V2>0$ when the multifeed sheet detecting part (C1) is in the state of detecting the multifed sheets.

In the above determination device for the sheets (S) having the constituent features (A01) to (A04), the paper feed member (Rs) has the paper feed roll (Rs1) and the separating member (Rs2) forming the nip unit (N) by the mutually pressure contact portions or the mutually adjacent and opposite portions. When two or more sheets (S) picked up from the paper feed trays (TR1, TR2) by the pick-up roll (Rp) are transported to the nip unit (N), the paper feed roll (Rs1) rotates to apply the force in the transport direction to the sheet transported to the nip unit (N), and the separating member (Rs2) generates the force for hindering when it comes into contact with the transported sheet (S). The paper feed member (Rs) having the paper feed roll (Rs1) and the separating member (Rs2) separates one sheet (S) on the paper feed roll (Rs1) side of two or more sheets (S) transported to the nip unit (N), and feeds the sheet toward the downstream in the sheet transport direction.

The separating member side sheet speed detecting part (C3) detects the transport speed V2 of the sheet surface on the separating member (Rs2) side of the sheet (S) in the course of passing through the nip unit (N) which is a pressure contact area of the paper feed roll (Rs1) and the separating member (Rs2).

The multifeed sheet detecting part (C1) detects the presence of two or more sheets (S) in the course of being transported through the nip unit (N).

The multifeed state determination part (C4) determines to be not in the multifeed state of the sheets (S)in the case where the sheet speed V2 detected by the separating member side sheet speed detecting part (C3) is $V2 \leqq 0$, and determines to be in the multifeed state of the sheets (S) in the case of $V2>0$ when the multifeed sheet detecting part (C1) is in the state of detecting the multifed sheets.

According to an aspect of the present invention, even if the multifeed sheet detecting part (C1) detects the presence of two or more sheets (S) in the course of being transported through the nip unit (N), in the case of V2≦0, the sheets (S) at the nip unit (N) are sent back or stopped, highly probably the multifeed is released or already has been released. In this case, the multi feed state is not decided so that the accuracy of determining the sheet multifeed state can be improved.

Further, a multifeed state determination device for a sheet according to another aspect of the invention is characterized by providing the following constituent features (A01), (A02), (A03'), (A04').

(A01) A paper feed member (Rs) including a paper feed roll (Rs1) and a separating member (Rs2) forming a nip unit (N) by mutually pressure contact portions or mutually adjacent and opposite portions, wherein the paper feed roll (Rs1) rotates to apply the force in the transport direction to a sheet S transported to the nip unit (N), and the separating member (Rs2) generates the force for hindering the transport when it comes into contact with the transported sheet (S), whereby when two or more sheets (S) picked up from paper feed trays (TR1, TR2) by a pick-up roll (Rp) are transported to the nip unit (N), one sheet (S) on the paper feed roll (Rs1) side of two or more sheets (S) is separated and fed to the downstream side in the sheet transport direction.

(A02) A-separating member side sheet speed detecting part (C3) which detects the transport speed V2 of a sheet surface on the separating member (Rs2) side of a sheet (S) in the course of passing through the nip unit (N), which is a pressure contact area of the paper feed roll (Rs1) and the separating member (Rs2).

(A03') A paper feed roll side sheet speed detecting part (C2) which detects the transport speed V1 of the sheet surface on the paper feed roll (Rs1) side of the sheet S passing through the nip unit (N).

(A04') A multifeed state determination part (C4), which determines the multifeed state of the sheets (S) when V1>V2>0 in the case where the sheet speed detected by the paper feed roll side sheet speed detecting part (C2) is taken as V1, the sheet speed detected by the separating member side sheet speed detecting part (C3) is taken as V2.

In the multifeed state determination device for the sheet (S) according to the invention having the above constituent features (A01), (A02), (A03'), (A04'), the paper feed member (Rs) has the paper feed roll (Rs1) and the separating member (Rs2) forming the nip unit (N) by the mutually pressure contact portions or the mutually adjacent and opposite portions. When two or more sheets (S) picked up from the paper feed trays (TR1, TR2) by the pick-up roll (Rp) are transported to the nip unit (N), the paper feed roll (Rs1) rotates to apply the force in the transport direction to the sheet transported to the nip unit (N), and the separating member (Rs2) generates the force for hindering the transport when it comes into contact with the transported sheet (S). The paper feed member (Rs) having the paper feed roll (Rs1) and the separating roll separates one sheet (S) on the paper feed roll (Rs1) side of two or more sheets (S) transported to the nip unit (N), and feeds the sheet toward the downstream in the sheet transport direction.

The separating member side sheet speed detecting part (C3) detects the transport speed V2 of the sheet surface on the separating member (Rs2) side of the sheet (S) in the course of passing through the nip unit (N) which is a pressure contact area of the paper feed roll (Rs1) and the separating member (Rs2).

The paper feed roll side sheet speed detecting part (C2) detects the transport speed V1 of the sheet surface on the paper feed roll (Rs1) side of the sheet (S) in the course of passing through the nip unit (N).

The multifeed state determination part C4 determines the multifeed state of sheets (S) in the case of V1>V2>0 when the sheet speed detected by the paper feed roll side sheet speed detecting part (C2) is taken as V1, and the sheet speed detected by the separating member side sheet speed detecting part (C3) is taken as V2.

According to another aspect of the invention, even if the multifeed sheet detecting part (C1) detects the presence of two or more sheets (S) in the course of passing through the nip unit (N), in the case of V2≦0, the sheets (S) at the nip unit (N) are sent back or stopped, so that the multifeed is highly probably released or has already been released. In this case, the multifeed state is not decided so as to improve the accuracy of determining the sheet multifeed state.

BRIEF DESCRIPTION OF THE DRAWINGS

Preferred embodiments of the present invention will be described in detail based on the followings, and the invention is not limited to the followings, wherein:

FIG. 2A is a general view; FIG. 2B is a diagram showing a separation roll and a torque limiter;

FIG. 3A is a diagram showing a rotary encoder fitted directly to a roll shaft; FIG. 3B is a diagram showing a contact roller rotary encoder for detecting the rotating speed of a roller rotating in contact with a moving sheet;

FIG. 4 is a block diagram showing the respective functions (functional block diagram) of a control unit of the sheet transport device of the invention;

FIG. 5 is a table for determining the sheet multifeed state;

DESCRIPTION OF PREFERRED EMBODIMENTS

Figure 1:
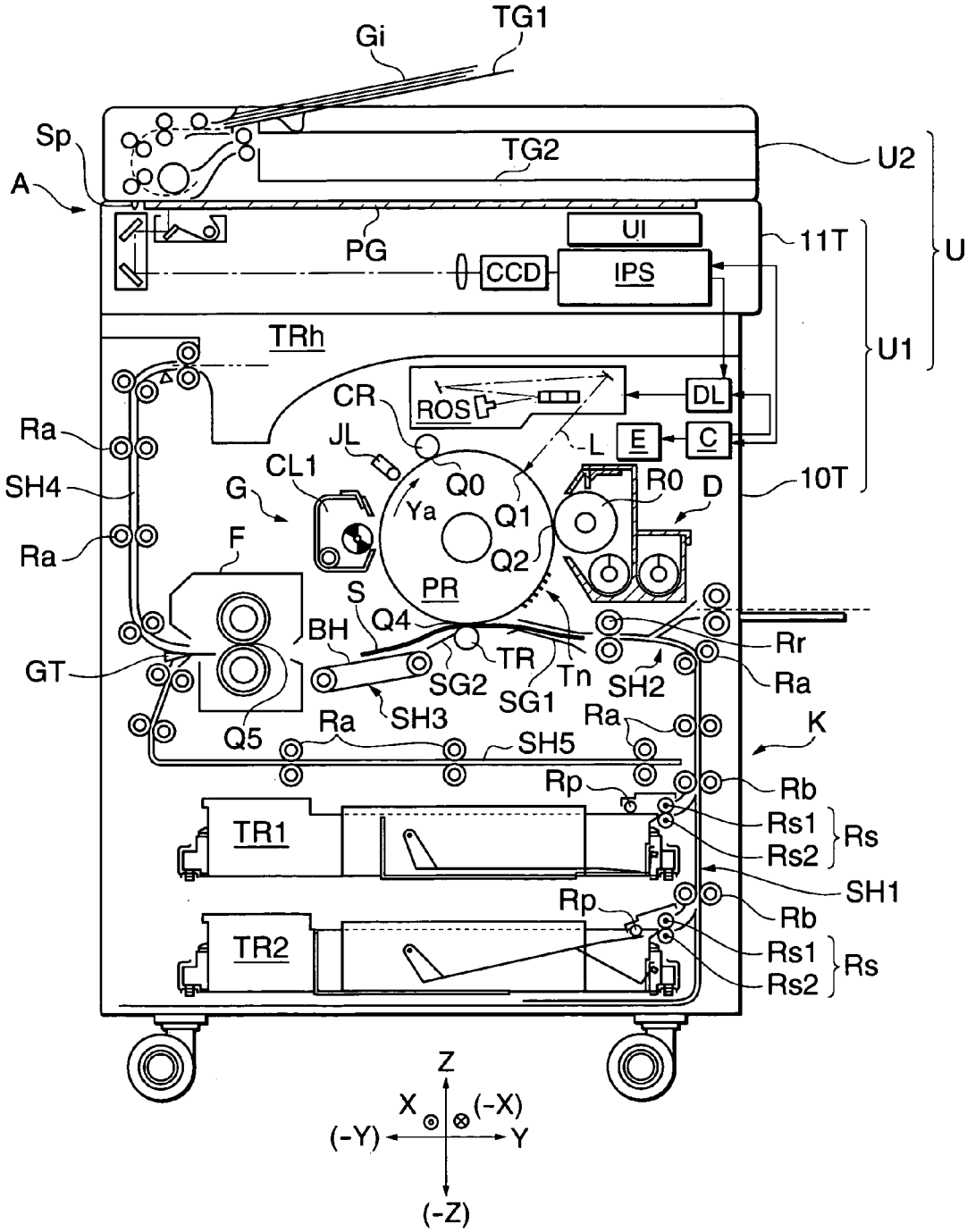
FIG. 1 is a longitudinal section of an image forming device including one sheet transport device of the invention.

FIG. 1 is a longitudinal section of an image forming device including one sheet transport device to which the invention is applied.

In FIG. 1, the image forming device U includes a digital copying machine body U1 as an image forming device body having a platen glass (transparent document table) PG on the top face, and an automatic document transport device (automatic document feeder, ADF) U2 removably mounted on the platen glass PG.

The automatic document transport device U2 has a document feed tray TG1 where two or more original document Gi to be copied are placed in a stack. The two or more original documents Gi placed in the document feed tray TG1 are respectively sequentially discharged through the copying position on the platen glass PG to a document discharge tray TG2.

The copying machine U1 has a UI (user interface), an IIT (image input terminal) as an image read unit, an IOT (image output terminal) as an image recording operation unit, and an IPS (image processing system) provided on the IIT or IOT, which are sequentially disposed below the platen glass PG.

The IIT as a document reader disposed below the transparent platen glass PG on the top face of the copying machine body U1 has an exposure system registration sensor (platen registration sensor) Sp disposed in a platen registration position and an exposure optical system A.

The exposure optical system A is controlled to move and stop according to a detection signal of an exposure system registration sensor Sp and normally stopped in a home position.

In the ADF mode of copying with the automatic document feeder U2, the respective original documents Gi sequentially passing through the copying position on the platen glass PG are exposed with the exposure optical system A stopped in the home position.

In a platen mode of manually placing an original document Gi on the platen glass PG and copying the same by an operator, the exposure optical system A exposure-scans the original document on the platen glass PG while moving.

The reflected light from the exposed original document Gi is converged through the exposure optical system A on a Charge Coupled Device (solid-state image pickup element). The CCD converts the reflected light of the original document converged on the imaging surface to an electric signal.

The IPS converts a read image signal input from the CCD to a digital image write signal, and outputs the same to a laser driving signal output device DL of the IOT.

The laser driving signal output device DL outputs a laser driving signal according to the input image data to an ROS (latent image write scanner). The IPS, the laser driving signal output device DL, a power supply circuit and the like are controlled to operate by a controller C formed by a computer.

A photoreceptor drum (toner image bearing member) PR disposed below the ROS is rotated in the direction of an arrow Ya. The surface of the photoreceptor drum PR is charged to, for example, minus 700V by a charger (charge roll) CR in a charging area Q0, and then exposure-scanned by a laser beam L of the ROS (latent image write device) at a latent image writing position Q1 to form an electrostatic latent image with −300 V or the like. The latent image formation on the photoreceptor drum PR by the laser beam L is started in a lapse of designated time after a sheet sensor (not shown) detects the leading edge of a sheet. The surface of the photoreceptor drum where the electrostatic latent image is formed is rotated and moved to sequentially pass through a developing area Q2 and a transfer area (image recording position) Q4.

A developing device D for developing the electrostatic latent image in the developing area Q2 carries a developer containing toner of minus charging polarity and carrier of plus charging polarity to the developing area Q2 by a developing roll R0 to develop the electrostatic latent image on the photoreceptor drum PR passing through the developing area Q2 into a toner image Tn.

In the transfer area (image recording position) Q4, a transfer roll RT opposite to the photoreceptor drum PR is a member for transferring the toner image on the surface of the photoreceptor drum PR to the sheet S, and transfer voltage opposite in polarity to the charging polarity of toner for development used in the developing device D is supplied to the transfer roll from a power supply circuit E. Bias such as charging bias applied to the charging roll, development bias applied to the developing roll, transfer bias applied to the transfer roll TR, and the power supply circuit E having a heater power supply for heating a heater of a heat roll of a fixing device F mentioned later are controlled by the controller C.

A first paper feed tray TR1 and a second paper feed tray TR2 are arranged on the upper and lower sides in the lower portion of the image forming device body U1.

A pick-up roll Rp is disposed at the upper end of the right end of each of the first paper feed tray TR1 and second paper feed tray TR2, and a sheet picked up by the pick-up roll Rp is transported to the right paper feed path SH1 of the respective paper feed trays TR1 and TR2.

In the paper feed path SH1, a paper feed member Rs is disposed, and the paper feed member Rs has a paper feed roll Rs1 and a separation roll (separating member) Rs2 forming a nip unit by mutual pressure contact portions thereof. The sheets transported to the nip unit are separated one by one by the paper feed member Rs and transported to the downstream portion of the sheet transport path SH1. The downstream portion of the sheet transport path SH1 is extended up and down, and a transport roll Rb rotated in the normal and reverse directions (normal and reverse rotation transport roll) is disposed in the portion. The sheet S transported to the sheet transport path SH1 is transported to an upper upstream sheet transport path SH2 by the normal and reverse rotation transport roll Rb.

The sheet S transported to the upstream sheet transport path SH2 is transported to a register roll Rr by the transport roll Ra. The sheet S transported to the register roll Rr is transported from a pre-transfer sheet guide SG1 to the transfer area Q4 in time to the moving of the toner image on the photoreceptor drum PR to the transfer area (image recording position) Q4.

The toner image Tn developed on the surface of the photoreceptor drum PR is transferred to the sheet S by the transfer roll TR in the transfer area Q4. After transfer, the surface of the photoreceptor drum PR is cleaned by a photoreceptor cleaner CL1 to remove residual toner. Subsequently static electricity is eliminated from the photoreceptor surface by a photoreceptor static eliminator JL and again charged by the charging roll CR.

An image recording member G (PR+CR+ROS+D+TR+CL1+JL) is formed of the photoreceptor drum PR, the charging roll CR, the ROS (latent image write device), the developing device D, the transfer roll TR, the photoreceptor cleaner CL1, the photoreceptor static eliminator JL and so on.

A downstream sheet transport path SH3 for a recorded sheet S where a toner image is recorded in the transfer area Q4 is provided on the downstream side in the sheet transport direction of the transfer area (image recording position)Q4. The sheet S to which the toner image is transferred by the transfer roll TR in the transfer area (image recording position) Q4 is separated from the surface of the photoreceptor drum PR, and transported to the fixing area Q5 by a sheet guide SG2 of the downstream sheet transport path SH3 and a sheet transport belt BH. The sheet S having the toner image is heat fixed by the fixing device F when passing through the fixing area Q5, and then transported to the discharged paper tray TRh through a sheet discharge path SH4.

In the sheet discharge path SH4, a switching gate (sheet transport direction control member) GT is disposed on the downstream side of the fixing device F. The switching gate GT switches the transport direction of the sheet S passed-through the fixing device F between the discharged paper tray TRh side and the sheet reverse connecting path SH5. The sheet reverse connecting path SH5 connects the upstream end of the sheet discharge path SH4 (downstream portion of the fixing device F) with the sheet transport path SH1.

In the case of both-sided copying, a one-side recorded sheet S where a toner image of the first side is already recorded is transported through the switching gate GT from the sheet reverse connecting path SH5 toward the lower side of the paper feed path SH1 by the normal and reverse rotation transport roll Rb at the upper end of the paper feed path SH1, and then switched back and reversed to be again transported to the upper upstream sheet transport path SH2.

The one-side recorded sheet S, which has been again transported to the upstream sheet transport path SH2 in the reverse state is again transported to the transfer area (image recording position) Q4 to transfer a toner image to the second side of the sheet.

Figure 2A:
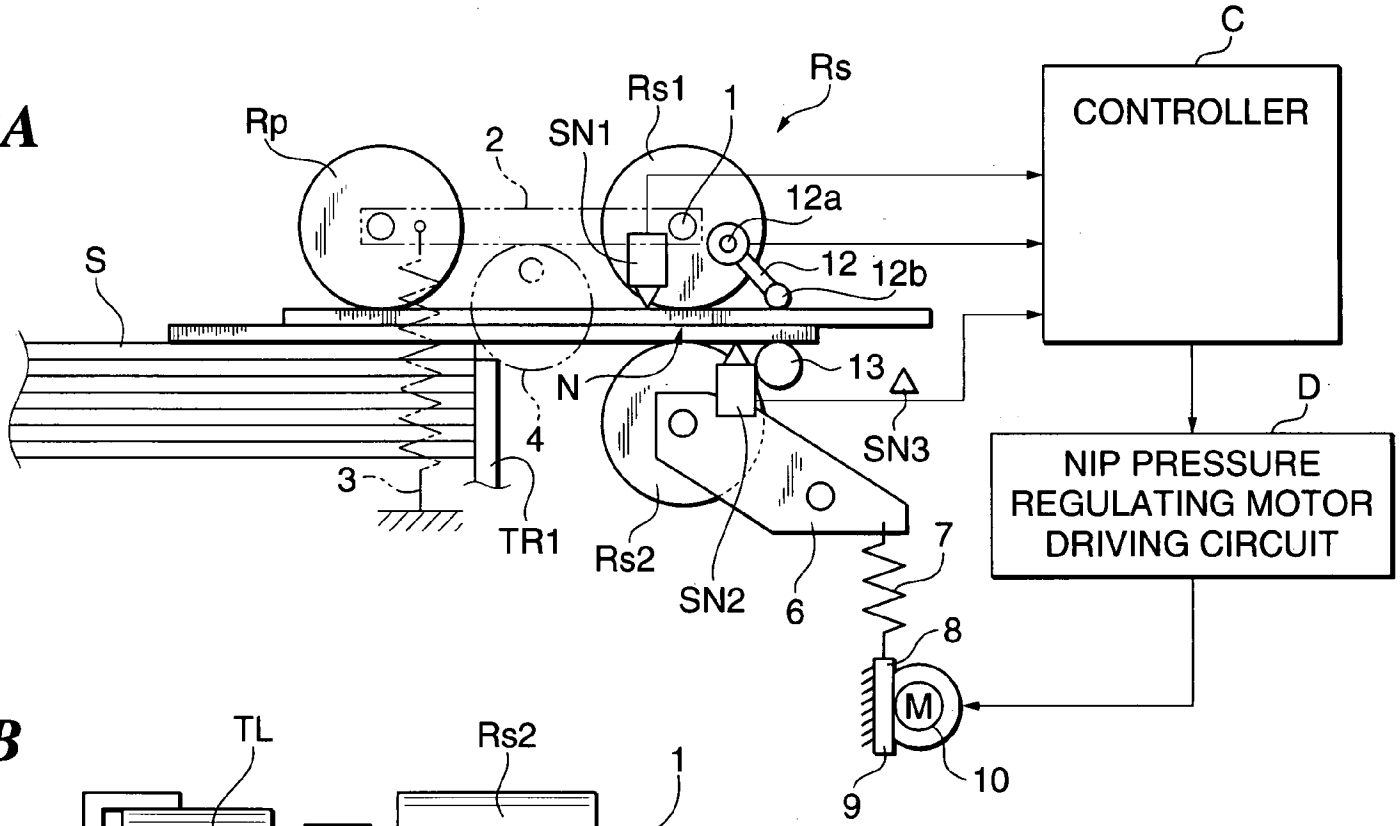
FIGS. 2A and 2B are diagrams for illustrating a paper feed member of the device.
Figure 2B:
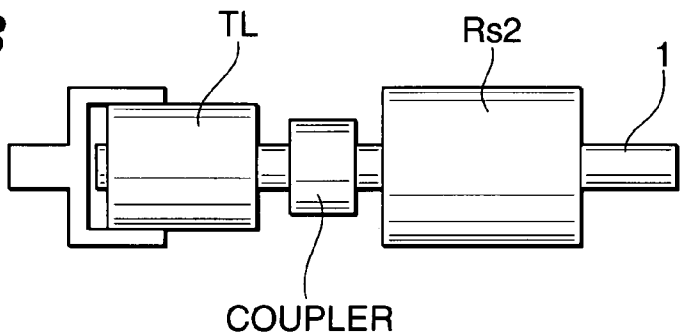

FIGS. 2A and 2B are diagrams illustrating a paper feed member of the sheet transport device, FIG. 2A is a general view, and FIG. 2B is a diagram showing a separation roll and a torque limiter.

In FIG. 2A, the paper feed member Rs has a paper feed roll Rs1 and a separation roll Rs2. A nip unit N is formed by the pressure contact portions of the paper feed roll Rs1 and the separation roll Rs2.

A rotary lever 2 is rotatably supported on a shaft 1 of the paper feed roll Rs1, and a pick-up roll Rp is rotatably supported on the left end of the rotary lever 2. The rotary lever 2 is always pulled downward by a tension spring 3, and subjected to the counter clockwise turning force around the shaft 1. The top face of an eccentric cam 4 abuts on the lower surface of the rotary lever 2, so that the sheet pressing force (the force for pressing the top face of the sheets S accommodated in the paper feed tray TR1) of the pick-up roll Rp can be controlled by rotating the eccentric cam 4. The eccentric cam 4 is rotated by a pressing force regulating motor M2 (See FIG. 4) for rotating the eccentric cam.

The shaft of the separation roll Rs2 is rotatably supported on a rotary arm 6, the rotary arm 6 is rotatable around a shaft 6*a*, and the right end of the rotary arm 6 is pulled downward by a tension spring 7. The lower end of the tension spring 7 is connected to the upper end of a vertically movable rack 8. The rack 8 is capable of sliding up and down along a slider 9 by rotation of a pinion 10 driven to rotate by a nip pressure regulating motor (nip regulating member) M1 (See FIG. 4). The nip pressure regulating motor M1 is driven by a nip pressure regulating motor driving circuit D1 controlled by the controller C.

The pressure of the nip unit N (nip pressure) can be regulated by controlling the position of the pinion 10.

A paper feed roll side sheet speed sensor SN1 for detecting the moving speed of the sheet surface on the paper feed roll Rs1 side of the sheet passing through the nip unit N is disposed on the upper side of the nip unit N, and a separation roll side sheet speed sensor SN2 for detecting the moving speed of the sheet surface of the separation roll Rs2 side of the sheet passing through the nip unit N is disposed on the lower side of the nip unit N.

On the upper side of the nip unit N, a multifeed detecting lever (sheet multifeed detector) 12 for detecting that plural sheets are transported in a pile to the nip unit N is supported to be rotatable around a shaft 12*a*, and a multifeed detecting roller 12*b* is supported to be rotatable on the tip of the multifeed detecting lever 12.

An opposite roller 13 is rotatably supported opposite to the multifeed detecting roller 12*b* on the lower side of the nip unit N. When a sheet enters between the multifeed detecting roller 12*b* and the opposite roller 13, the multifeed detecting roller 12*b* is lifted up according to the thickness of the sheet to turn the multifeed detecting lever 12. The thickness of the sheet entering the nip unit N can be detected by a sensor (multifeed sheet sensor) SN4 (See FIG. 4) for detecting the turning angle of the multifeed detecting lever 12 at the time. The multifed sheets can be detected according to the detected thickness of the sheet.

On the downstream side of the nip unit N, a sheet sensor SN3 is disposed, and when the sheet sensor SN3 detects the leading end of the sheet, it can be detected that the sheet is transported through the nip unit N.

In FIG. 2B, a torque limiter TL and a coupler 15 are provided between a separation roll rotary driving shaft 14 for transmitting the rotating force to the separation roll Rs2 and the shaft of the separation roll Rs2. Accordingly, when the sheet is transported to the nip unit N, in the case where the paper feed roll Rs1 rotates in the sheet transport direction to transport the sheet, the sheet coming into contact with the separation roll Rs2 is subjected to frictional resisting force depending on the torque limiter. Therefore, when plural sheets are multifed to the nip unit N, the sheet coming into contact with the separation roll Rs2 can be prevented from being transported.

The paper feed roll side sheet speed sensor SN1 and the separation roll side sheet speed sensor SN2 shown in FIG. 2 are sensors adapted to detect the speed of the sheet according to the moving speed of a picked-up image of the sheet surface, and the sensors of this type are on sale.

Figure 3B:
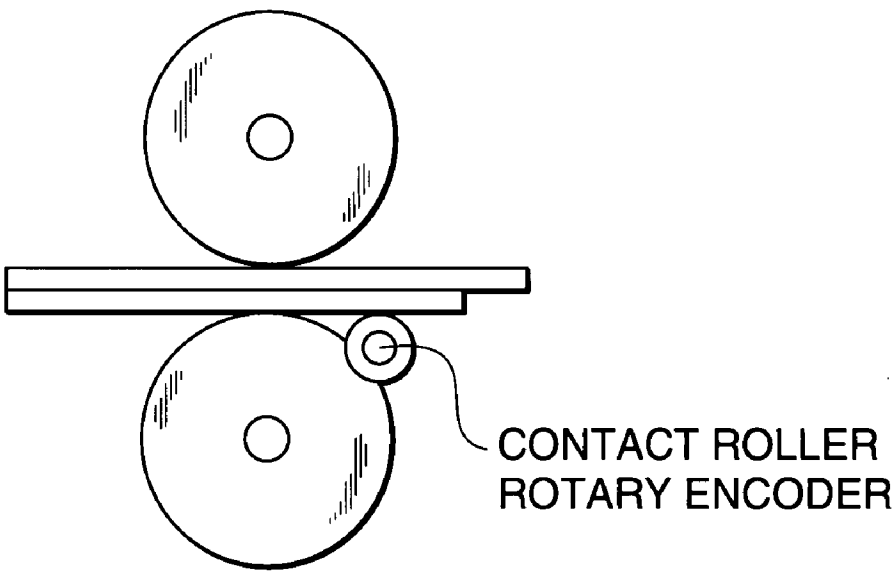
FIGS. 3A and 3B are diagrams showing another example of a sheet speed sensor used instead of a paper feed roll side sheet speed sensor SN1 and a separation roll side sheet speed sensor SN2.
Figure 3A:
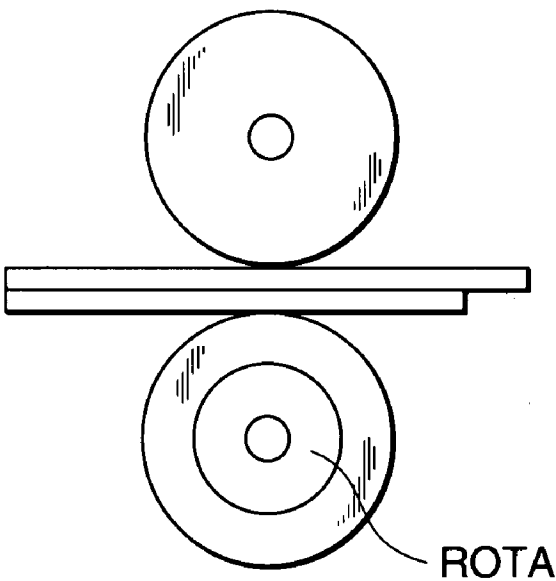

FIGS. 3A and 3B are diagrams showing another example of sheet speed sensor usable instead of the paper feed roll side sheet speed sensor SN1 and the separation roll side sheet speed sensor SN2, FIG. 3A is a diagram showing a rotary encoder fitted directly to the roll shaft, and FIG. 3B is a diagram showing a contact roller rotary encoder for detecting the rotating speed of a roller rotated in contact with a moving sheet.

The rotary speed sensors using the encoders shown in FIGS. 3A and 3B are on sale, and the rotary speed sensors of this type are used as the sheet speed sensor instead of the sensors SN1, SN2 shown in FIG. 2.

(Description of the Control Unit of the Sheet Transport Device)

FIG. 4 is a block diagram showing the respective functions (functional block diagram) of the control unit of the sheet transport device according to the invention.

In FIG. 4, the controller C includes an I/O (input/output interface) not shown for inputting/outputting a signal to and from the outside and controlling the input/output signal level, a ROM (read only memory) storing a program and data for performing necessary processing, a RAM (random access memory) for temporarily storing necessary data, a CPU (central processing unit) for performing processing according to the program stored in the ROM, and a computer having a clock oscillator or the like, and the controller can realize various functions by executing the program stored in the ROM.

(Signal Input Element Connected to the Controller C)

Signals of the UI (user interface), the paper feed roll side sheet speed sensor SN1, the separation roll side sheet speed sensor SN2, the sheet sensor SN3 for detecting that a sheet is transported to the nip unit N, the sheet multifeed sensor SN4, and the other signal input elements are input to the controller C.

The UI is provided with a display device, a tray selection key, a mode select key and the like.

(Controlled Elements Connected to the Controller C)

The controller C is connected to a nip pressure regulating motor driving circuit D1, a separation roll driving motor driving circuit D2, a pressing force regulating motor driving circuit D3, a power supply circuit E, and the other controlled elements, and operation control signals thereof are output.

The nip regulating motor driving circuit D1 regulates the nip pressure by elevating the rack 8 (See FIG. 2A) through the nip pressure regulating motor M1 to elevate the separation roll Rs2.

The separation roll driving motor driving circuit D2 drives the separation roll Rs2 to rotate in the reverse direction to the sheet transport direction through the separation roll driving motor M2, and regulates a driving current to control the turning torque.

The pressing force regulating motor driving circuit D3 rotates the cam 4 (See FIG. 2) through the pressing force regulating motor M3, thereby elevating the rotary lever 2 around the shaft 1 of the paper feed roll to regulate the sheet pressing force of the pick-up roll Rp.

The power supply circuit E has a developing bias power supply circuit for applying developing bias to the developing roll of the developing device D, a charging power supply circuit for applying charging voltage to the charging roll CR (charging roll), an LD driving power supply circuit, a transfer power supply circuit, a fixing power supply circuit and the like, and the operation timing or the like thereof is controlled by the controller C.

(Function of the Controller C)

The controller C has the following control elements C1 to C6), and the respective control elements C1 to C6 have designated functions for performing the processing according to the input signals from the signal output elements to output control signals to the respective controlled elements.

C1: Multifeed Sheet Detecting Part

The multifeed sheet detecting part C1 detects whether the presence of multifed sheets or not according to a detection signal of the multifeed sheet sensor SN4.

C2: Paper Feed Roll Side Sheet Speed Detecting Part

The paper feed roll side sheet speed detecting part C2 detects the paper feed roll side sheet speed V1 according to a detection signal of the paper feed roll side sheet speed sensor SN1.

C3: Separation Roll Side (Separating Member Side) Sheet Speed Detecting Part

The separation roll side sheet speed detecting part C3 detects the separation roll side sheet speed V2 according to a detection signal of the separation roll side sheet speed sensor SN2.

C4: Multifeed State Determination Part

The multifeed state determination part C4 has a multifeed state determination table C5*a* (See FIG. 5) and determines whether the multifeed state or not.

C5: Separation Roll Rotation Control Part

The separation roll rotation control part C5 rotates the separation roll Rs2 in the reverse direction to the sheet transport direction in the condition where the multifeed state determination part C5 determines to be multifeed.

C6: Nip Regulating Part

The nip regulating part C6 controls the operation of the nip pressure regulating motor (nip regulating member )M1 to release the multifeed in the condition where the multifeed state determination part C4 determines to be multifeed.

FIG. 5 is a table for determining the sheet multifeed state.

In FIG. 5, the sheet transport state is determined as in the following according to the detection signals V1 of the multifeed sensor SN4 and the paper feed roll side sheet speed sensor SN1 and the detection signal V2 of the separation roll side sheet speed sensor SN2.

(1) When SN4=OFF, V2=V1, it is normal (only one sheet is transported).

(2) When SN4=ON, V2=0, normal (the second is stopped).

(3) When SN4=ON, V2<0, normal (the second is sent back).

(4) When SN4=N, V2=V1, multifeed (close contact state).

(5) When SN4=ON, V1>V2>0, multifeed (imperfect separation).

(Description of Flowchart)

Figure 6:
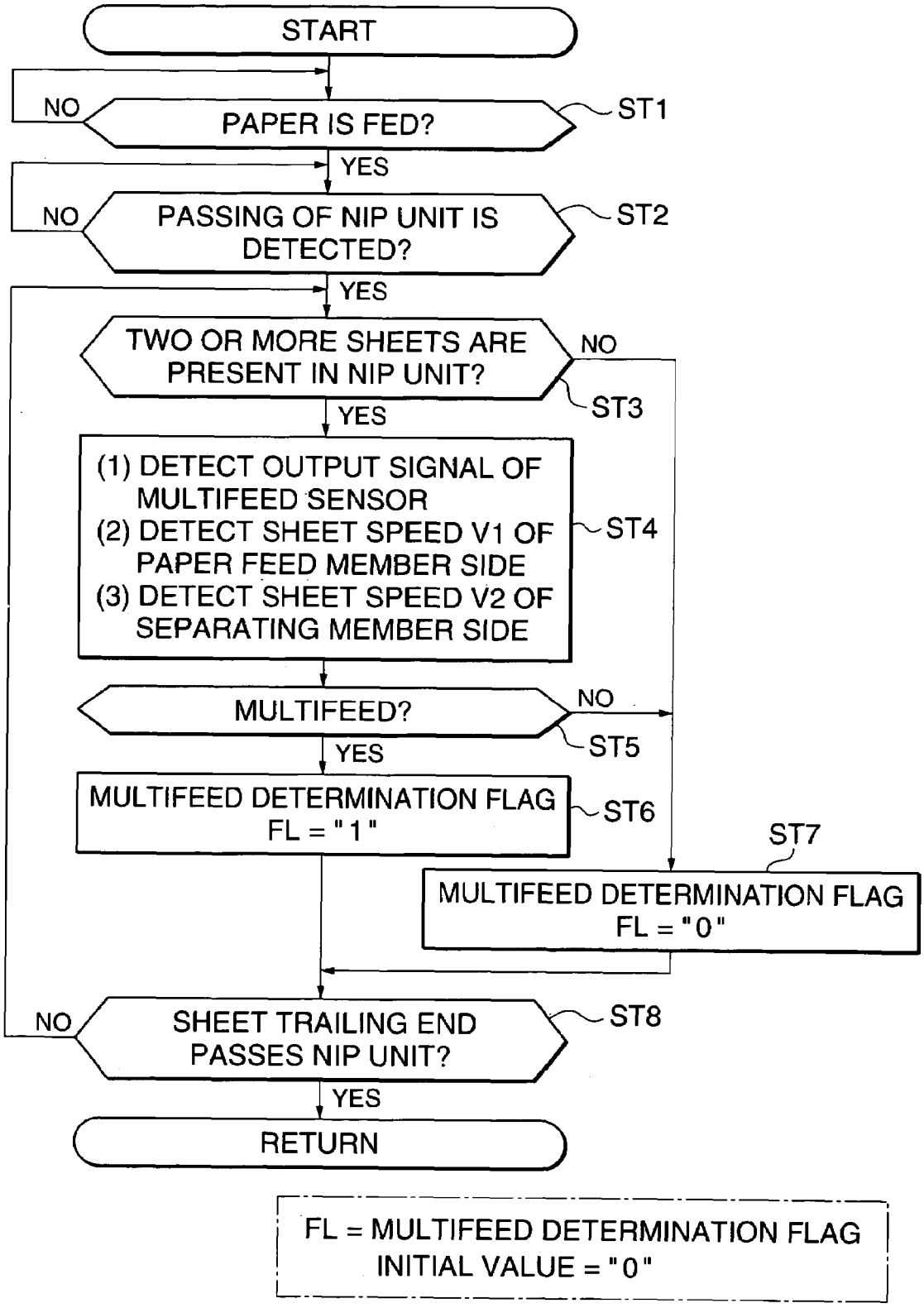
FIG. 6 is a flowchart of sheet multifeed state determination processing of a sheet determination device of the sheet transport device of the invention.

FIG. 6 is a flowchart of sheet multifeed state determination processing of the sheet determination device according to the invention 1.

The processing of each step (ST) of the flowchart in FIG. 6 is performed according to the program stored in the ROM of the controller C. The processing is performed in multi tasking operation concurrently with each processing of the others of the image forming device U (See FIG. 1).

The sheet multifeed state determination processing shown in FIG. 6 is started simultaneously with the power-on. In the step ST1 of FIG. 6, it is decided whether paper is fed or not. If NO, the step ST1 is repeated, and if YES, the transition to the step ST2 occurs.

In the step ST2, it is determined whether the leading edge of the sheet passes through the nip unit or not. If NO, the step ST2 is repeated, and if YES, the transition to the next step ST3 occurs.

In the step ST3, it is determined whether two or more sheets are present in the nip unit or not. This determination is performed depending on whether the multifeed sensor SN4 is OFF or ON. If NO, the transition to the step ST7 occurs, and if YES, the transition to the next step ST4 occurs.

In the step ST4, the following processing (1) to (3) is performed.

(1) Detect the output signal of the multifeed sensor.

(2) Detect the paper feed member side sheet speed V1.

(3) Detect the separating member side sheet speed V2.

The transition to the step ST 5 occurs.

In the step ST5, it is determined whether multifeed or not. This determination is performed according to the sheet multifeed state determination table C5*a* (See FIG. 5). If NO, the transition to the step ST7 occurs, and if YES, the transition to the step ST6 occurs.

In the step ST6, a multifeed discrimination flag FL is set to "1".

In the step ST7, the multifeed discrimination flag FL is set to "0".

Subsequently, in the step ST8, it is determined whether the sheet trailing edge passes through the nip unit or not. If NO, it returns to the step ST3, and if YES, it returns to the step ST1.

Figure 7:
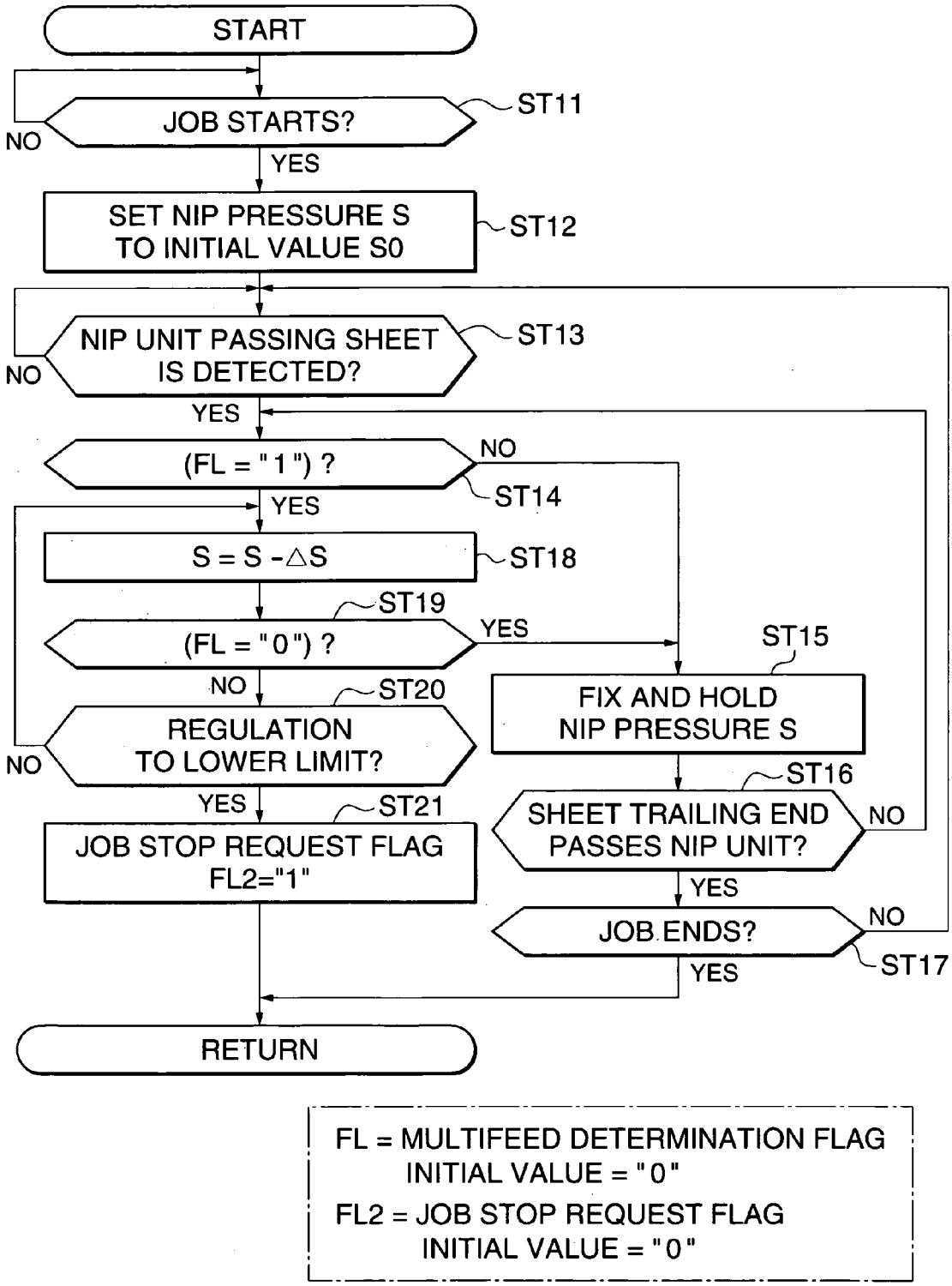
FIG. 7 is a flowchart of a separating pressure regulating processing of the sheet transport device 1 of the invention.

FIG. 7 is a flowchart of separating pressure regulating processing according to the invention 1.

In the step ST11 of FIG. 7, it is determined whether the job is started or not. If NO, the step ST11 is repeated, and if YES, the transition to the step ST12 occurs.

In the step ST12, the nip pressure S is set to the initial value S0. Subsequently, the transition to the step ST13 occurs.

In the step ST13, it is determined whether the sheet leading edge passes through the nip unit or not. If NO, the step ST13 is repeated, and if YES, the transition to the step ST14 occurs.

In the step ST14, it is determined whether the multifeed discrimination flag FL is "1" or not. If NO, the transition to the step ST15 occurs, and if YES, the transition to the step ST18 occurs.

In the step ST15, the nip pressure S is fixed and kept. Subsequently, the transition to the step ST16 occurs.

In the step ST16, it is determined whether the sheet trailing edge passes through the nip unit or not. If NO, it returns to the step ST14, and if YES, it returns to the step ST17.

In the step ST17, it is determined whether the job is ended or not. If NO, it returns to the step ST13, and if YES, it returns to the step ST11.

In the step ST18, the nip pressure S is taken as $S=S-\Delta S$. $\Delta S$ is a very small preset value. Subsequently, the transition to the step ST19 occurs.

In the step ST19, it is determined whether the multifeed discrimination flag FL is "0" or not. If YES, the transition to the step ST15 occurs, and if NO, the transition to the step ST20 occurs.

In the step ST20, it is determined whether the nip pressure S reaches the lower limit value or not. If NO, it returns to the step ST18, and if YES, the transition to the step ST21 occurs.

In the step ST21, the job stop request flag FL2 is set to "1". The initial value of the job stop request flag FL2 is set to "0". Subsequently, it returns to the step ST11.

(Operation of the Device)

Figure 8:
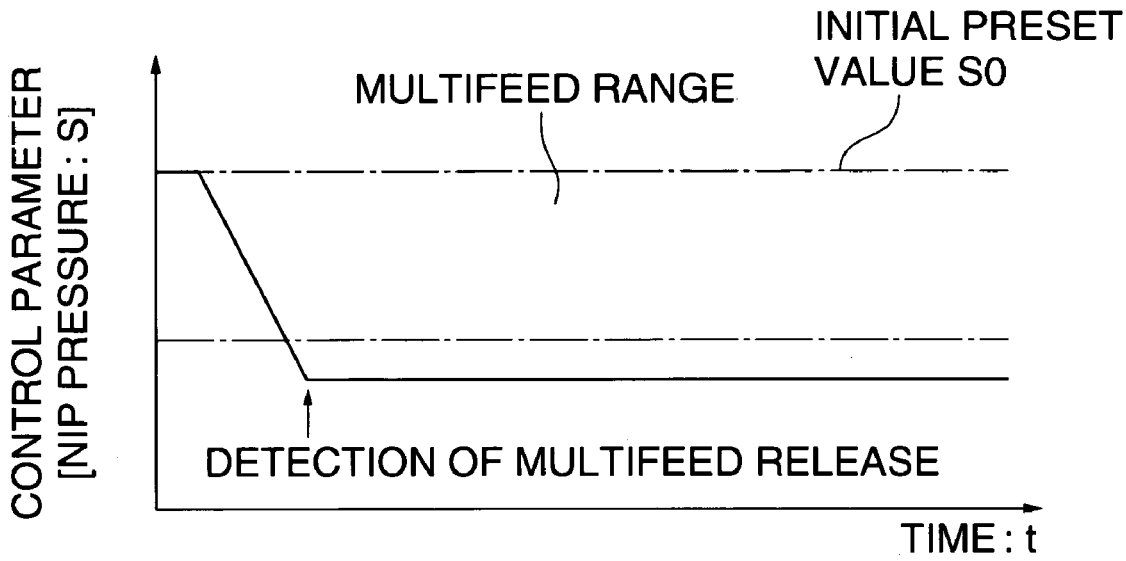
FIG. 8 is a timing diagram of nip pressure of a sheet transported according to the flowchart of the separating pressure (nip pressure) regulating processing of FIG. 7.

FIG. 8 is a timing diagram of the nip pressure of a sheet transported according to the flowchart of the separating pressure (nip pressure) regulating processing in FIG. 7.

When the nip pressure is controlled according to the flowchart of FIG. 7, the nip pressure changes as shown in the timing diagram of FIG. 8.

In FIG. 8, in the case where the nip pressure S is set to the initial preset value S=S0, and paper feeding is started, when the multifeed is determined in the course of paper feeding operation, the nip pressure S is gradually lowered. After release of multifeed is determined, the nip pressure in releasing the multifeed is kept.

In the device, it is determined whether the sheets are in the multifeed state or not according to the detection value of the multifeed sheet detecting part C1 and the value of the paper feed roll side sheet speed V1 or the separation roll side sheet speed V2, whereby the sheet multifeed state can be accurately determined.

(Modified Form)

Although a mode for carrying out the invention is described in detail, the invention is not limited to the modes for carrying out the invention, but modifications may be made within the scope of the gist of the invention. Modifications of the mode for carrying out the invention will now be illustrated.

(H01) Although the nip pressure is regulated as a control parameter in the device, it is possible to regulate a driving current of the separation roll driving motor M1 instead of the nip pressure. In this case, the torque limiter is removed, and the separation torque of the separation roll can be regulated by the torque of the motor M1. The torque of the motor M1 is regulated by a driving current.

(H02) The invention can be applied to the image forming device other than the printer such as a copying machine.

(H03) The invention can be applied to the image forming device using image write devices other than a laser write device, for example, a liquid crystal panel, a light emitting diode or a vacuum fluorescent display.

The entire disclosure of Japanese Patent Application No. 2003-081418 filed on Mar. 24, 2003 including specification, claims, drawings and abstract is incorporated herein by reference in its entirety.

What is claimed is:

1. An image forming device comprising:

a paper feed roll which applies force in a transport direction to a sheet and a separating member which applies a force in a direction of hindering the transport of the sheet, in which plural multifed sheets are separated by the paper feed roll and the separating member;

a paper feed roll side sheet speed detecting part which detects a transport speed V1 of a sheet on a paper feed roll side;

a separating member side sheet speed detecting part which detects a transport speed V2 of a sheet on a separating member side;

a multifeed sheet detecting part which detects a transport of plural sheets; and a control part which determines a sheet multifeed state and controls paper feed when the relationship between the speed V1 detected by the paper feed roll side sheet speed detecting part and the speed V2 detected by the separating member side sheet speed detecting part is $V1>V2>0$ and the multifeed sheet detecting part detects the transport of plural sheets.

2. The image forming device according to claim 1, wherein the image forming device further comprises a nip regulating member which regulates nip pressure which is the pressure contact force of the paper feed roll and the separating member or a nip space which is the space between the paper feed roll and the separating member, and in the condition of determining the multifeed state, the operation of the nip regulating member is controlled.

3. The image forming device according to claim 1, further comprising:

a nip regulating member which regulates nip pressure which is the pressure contact force of the paper feed roll and the separating member or a nip space which is the space between the paper feed roll and the separating member; and a nip regulating part which controls the operation of the nip regulating member by gradually lowering nip pressure to release the multifeed state in the condition where the multifeed sheet detecting part determines a multifeed state.

4. An image forming apparatus using a paper feeding device for feeding a paper, comprising:

a paper feeder for feeding the paper, wherein the paper feeder contacts an upper side of at least one paper and applies a force thereto in a transport direction of the paper;

a separating feeder that contacts a lower side of the at least one paper and applies a force thereto in a reverse direction to the transport direction;

a plural-paper detector that detects a plurality of papers transported between the paper feeder and the separating feeder;

a paper feeder side paper speed detector that detects a transport speed V1 of the paper in contact with the paper feeder;

a paper speed detector that detects a transport speed V2 of the paper in contact with the separating feeder; and a controller for determining a paper feeding state as a non-multifeed state or a multifeed state based on the result of detection by the plural-paper detectors, the paper feeder side paper speed detector and the paper speed detector, and, upon determining the paper feeding state as the multifeed state, controlling the separating feeder to separate the plurality of papers and continue transporting the single paper in contact with the paper feeder.

5. The image forming apparatus as set forth in claim 4, wherein the controller is controlling paper feeding as the multifeed state when the relationship between the transport speeds V1 and V2 detected by the paper speed detector and the paper feeder side paper speed detector is V1>V2>0.

6. The image forming apparatus as set forth in claim 5, wherein when the plural-paper detector detects the transport of the plurality of papers, the controller is controlling paper feeding as the multifeed state.

7. The image forming apparatus as set forth in claim 5, wherein when the plural-paper detector detects the transport of the plurality of papers and the relationship between the transport speeds V1 and V2 detected by the paper speed detector and the paper feeder side paper speed detector is V1=V2, the controller is controlling paper feeding as the multifeed state.

8. The image forming apparatus as set forth in claim 5, wherein when the plural-paper detector does not detect the transport of the plurality of papers and the relationship between the transport speeds V1 and V2 detected by the paper speed detector and the paper feeder side paper speed detector is V1=V2, the controller is controlling paper feeding as the non-multifeed state.

* * * * *